US010999918B2

(12) United States Patent
Koba et al.

(10) Patent No.: US 10,999,918 B2
(45) Date of Patent: May 4, 2021

(54) X-RAY TUBE AND X-RAY GENERATION DEVICE

(71) Applicants: ANRITSU INFIVIS CO., LTD., Kanagawa (JP); YAMAGUCHI UNIVERSITY, Yamaguchi (JP)

(72) Inventors: Hiroyuki Koba, Kanagawa (JP); Jyunichi Moriya, Kanagawa (JP); Yoshifumi Takahashi, Kanagawa (JP); Hiroki Kurisu, Yamaguchi (JP)

(73) Assignees: ANRITSU INFIVIS CO., LTD., Kanagawa (JP); YAMAGUCHI UNIVERSITY, Yamaguchi (JP)

( * ) Notice: Subject to any disclaimer, the term of this patent is extended or adjusted under 35 U.S.C. 154(b) by 0 days.

(21) Appl. No.: 16/772,015

(22) PCT Filed: Dec. 11, 2018

(86) PCT No.: PCT/JP2018/045573
§ 371 (c)(1),
(2) Date: Jun. 11, 2020

(87) PCT Pub. No.: WO2019/117172
PCT Pub. Date: Jun. 20, 2019

(65) Prior Publication Data

US 2021/0092823 A1 Mar. 25, 2021

(30) Foreign Application Priority Data

Dec. 14, 2017 (JP) ..... JP2017-239603

(51) Int. Cl.
*H05G 1/10* (2006.01)
*H05G 1/30* (2006.01)
(Continued)

(52) U.S. Cl.
CPC ..... *H05G 1/30* (2013.01); *H01J 35/18* (2013.01); *H05G 1/265* (2013.01)

(58) Field of Classification Search
CPC ..... G01N 2223/076; G01N 23/223; G01N 23/04; G01N 2223/6116;
(Continued)

(56) References Cited

U.S. PATENT DOCUMENTS 3,062,960 A * 11/1962 Laser ..... H05G 1/66 378/93
3,428,803 A * 2/1969 Grundhauser ..... G01N 23/04 250/306
(Continued)

FOREIGN PATENT DOCUMENTS

JP S55-119397 A 9/1980
JP S62-160454 U 10/1987
(Continued)

OTHER PUBLICATIONS

International Search Report Issued in Patent Application No. PCT/JP2018/045573 dated Mar. 12, 2019.
(Continued)

*Primary Examiner* — Irakli Kiknadze
(74) *Attorney, Agent, or Firm* — Pearne & Gordon LLP

(57) ABSTRACT

An X-ray tube, including: an envelope (11) that holds inside thereof at a predetermined pressure; a filament (12) for emitting electrons and a focus electrode (13) provided in the envelope: and a target (15) for generating X-ray provided in the envelope facing to the filament (12) and the focus electrode (13), wherein the envelope (11) has an envelope body (11*a*) and an X-ray window portion (16) having a higher X-rays transmissivity and a higher electric conductivity than the envelope body (11*a*), when the X-ray window portion (16) or the anode (14) is set to a lower electric
(Continued)

potential than both of an electric potential of the anode (14) or the X-ray window portion (16) and an electric potential of the filament (12) and the focus electrode (13), detection of at least one of an ion current (Ii) or an electron current (Ie) through the X-ray window portion (16) or the anode (14) is possible.

9 Claims, 7 Drawing Sheets

(51) Int. Cl.
*H05G 1/26* (2006.01)
*H01J 35/18* (2006.01)

(58) Field of Classification Search
CPC ..... G01N 2223/6462; G01N 2223/309; G01N 2223/6113; G01N 23/083; G01N 2223/3306; G01N 2223/401; G01N 2223/408; G01N 2223/646; G01N 23/044; G01N 23/12; G01N 23/18; G01N 23/20; G01N 33/2847; G01N 2223/1016; H05G 1/30; H05G 1/44; H05G 1/46; H05G 1/34; H05G 1/10; H05G 1/04; H05G 1/20; H05G 1/22; H05G 1/265; H05G 1/66; H05G 1/70; H05G 1/00; H05G 1/26; H05G 1/06; H05G 1/32; H05G 1/52; H05G 1/54; H05G 1/36; H05G 1/56; H05G 1/64; H01J 33/00; H01J 35/147; H01J 2235/168; H01J 35/025; H01J 35/14; H01J 35/00; H01J 35/20; H01J 2201/342; H01J 35/065; H01J 35/08; H01J 35/186; H01J 35/30; H01J 35/32; H01J 2237/24415; H01J 47/02; G01L 315/00; A61L 390/11; A61N 2005/1005; A61N 5/1001; G01T 1/185; G21K 1/025
USPC ..... 378/62, 101
See application file for complete search history.

(56) References Cited

U.S. PATENT DOCUMENTS

| | | | | |
|---|---|---|---|---|
| 6,449,337 | B1 | 9/2002 | Honda et al. | |
| 2004/0247080 | A1* | 12/2004 | Feda | H05G 1/46 378/101 |
| 2008/0130834 | A1* | 6/2008 | Bosello | H05G 1/34 378/103 |
| 2009/0161823 | A1* | 6/2009 | Groves | G01N 33/2847 378/53 |
| 2010/0020938 | A1* | 1/2010 | Koch | H01J 35/153 378/138 |

FOREIGN PATENT DOCUMENTS

| | | | |
|---|---|---|---|
| JP | 2001-145625 | A | 5/2001 |
| JP | 3211415 | B2 | 9/2001 |
| JP | 2007-042516 | A | 2/2007 |
| JP | 2014-002023 | A | 1/2014 |
| JP | 2016-146288 | A | 8/2016 |
| JP | 2017-123246 | A | 7/2017 |

OTHER PUBLICATIONS

Written Opinion Issued in Patent Application No. PCT/JP2018/045573 dated Mar. 12, 2019.

* cited by examiner

X-RAY TUBE AND X-RAY GENERATION DEVICE

FIELD OF THE INVENTION

The present invention relates to an X-ray tube and an X-ray generation device, and more particularly to an X-ray tube and an X-ray generation device capable of measuring the pressure in an envelope.

BACKGROUND ART

In an article inspection or the like for irradiating an inspection article with X-rays, generally, an X-ray tube as an X-ray generation source and an X-ray generation device provided with the X-ray tube are used.

The X-ray tube is usually a high-vacuum vacuum ceiling device of, for example, about $10^{-4}$ Pa. When deterioration of the vacuum occurs, generation of an abnormal discharge due to deterioration of the vacuum causes fluctuation of X-ray intensity, thereby making it liable to cause an abnormality in the inspection using the X-ray.

Then, technologies for measuring the pressure in the envelope of an X-ray tube using the electrode of an X-ray tube are conventionally known (for example, refer Patent Documents 1, 2, and 3).

Such an X-ray tube or an X-ray generation device provided with the same has an advantage that it is not necessary to additionally install a vacuum gauge to measure the pressure of the X-ray tube, so that the X-ray tube has the pressure measurement function at a comparatively low cost.

CITATION LIST

Patent Literature

Patent Document 1: Japanese Patent Application Publication No. 2016-146288

Patent Document 2: Japanese Patent No. 3211415

Patent Document 3: Japanese Patent Application Publication No. 2014-2023

SUMMARY OF THE INVENTION

Technical Problem

However, in the conventional X-ray tube and X-ray generation device as described above, there is a problem that the pressure in the X-ray tube cannot be detected with high accuracy.

Specifically, considering the fact that the operating vacuum region of the X-ray tube is about $10^{-4}$ Pa (immediately after production) to about 10 Pa (lifetime reached) and that the X-ray tube has a filament on the cathode side, it would be suggested to use the principle of the so-called ionization vacuum gauge in the pressure detecting section, so that the X-ray tube has the pressure measurement function of high accuracy.

The ionization vacuum gauge has a triode structure including a filament, an anode, and an ion collector. The ionization vacuum gauge collects ionized gas, which is a positive ion, generated by collision of electrons emitted from the filament and accelerated by a high positive electric potential anode, and gauges an ion current Ii, while allowing the electrons emitted from the filament to arrive at the anode having the high positive electric potential and gauging an electron current Ie, thereby to gauge a pressure P by the equation (1) as shown below.

$$P=(1/S)\cdot(Ii/Ie) \quad (1)$$

In the equation (1), S is a coefficient called sensitivity, which can be expressed by the formula (2) as shown below, where the ion collection efficiency of the ion collector is β, the ionization efficiency of gas (probability of electrons ionizing gas molecules) is σ, the free path length of electrons is L, Boltzmann's constant is k, and the absolute temperature of the gas is T.

$$S=\beta\cdot(\sigma/kT)\cdot L \quad (2)$$

When this is applied to an X-ray tube, the electrons emitted from the filament on one electrode side of the X-ray tube are accelerated by setting a focus electrode associated with the vicinity of the filament to a high positive electric potential, the accelerated electrons are collided with gas molecules in the X-ray tube to ionize the gas molecules to generate positive ions, and the positive ions are made to arrive at the target side, which is the other electrode that serves as an ion collector, so that the ion current can be measured. On the other hand, the electron current can be measured by causing electrons to arrive at a high positive electric potential focus electrode that serves as an anode.

However, in the case that a pressure measurement function is added to the X-ray tube by using the electrodes in the envelope of the X-ray tube as explained above, since it is difficult to secure a long distance between the filament and the focus electrode in a normal size X-ray tube, the sensitivity S becomes small, and due to this, the ion current becomes weak, so that the required detection sensitivity for detection of the required pressure of about $10^{-4}$ Pa cannot be obtained.

In addition, there is such a problem that, when measuring the pressure with the filament, which is the cathode of the X-ray tube, kept at a negative electric potential, a part of the positive ions generated in the vicinity of the filament arrive at the filament side, so that the positive ions arriving at the target decrease, thereby largely deteriorating the detection efficiency of the ion current.

Therefore, conventionally, there has been such a problem that, even if the X-ray tube is provided with a pressure measurement function, it is difficult to detect the pressure of the X-ray tube with high sensitivity, so that it is impossible to appropriately prevent an abnormal discharge of the X-ray tube and monitor lifetime of the X-ray tube.

The present invention has been made to solve the conventional problems as described above, and it is an object of the present invention to provide an X-ray tube and an X-ray generation device capable of detecting the pressure of the X-ray tube with high sensitivity.

Means to Solve the Problem

In order to achieve the above object, the X-ray tube according to the present invention comprises: an envelope that holds inside thereof at a predetermined pressure;

a cathode provided in the envelope, the cathode emitting electrons; and an anode provided in the envelope facing to the cathode, the anode generating X-ray, wherein the envelope has an envelope body and an X-ray window portion having a higher X-rays transmissivity and a higher electric conductivity than those of the envelope body, when either one part of the X-ray window portion or the anode is set to a lower electric potential than both an electric potential of the other part of the X-ray window portion or the anode and an electric potential of the cathode, detection of at least either one of an ion current through the one part or an electron current through the other part is possible.

In the present invention, a part of gas molecules in the envelope is ionized to form positive ions by collision with electrons flying from the cathode to the anode, and the positive ions arrive at the other part of the X-ray window portion or the anode which is set to a lower electric potential than either an electric potential of one part of the X-ray window portion or the anode or an electric potential of the cathode, so that the ion current flows through the other part of the X-ray window portion or the anode. In this case, since the cathode and the X-ray window portion or the anode are spaced apart, the free path length of the electrons can be increased, so that the collision probability of the electrons and the gas molecules becomes high, making the measurement of the ion current easier, thereby making it possible to detect the pressure of the X-ray tube with high sensitivity.

In the present invention, the X-ray tube may be so configured that the one part is the X-ray window portion, and the other part is the anode. Or, the X-ray tube may be so configured that the one part is the anode and the other part is the X-ray window.

Further, the X-ray tube may be so configured that the X-ray window portion is made of metal having a predetermined electric conductivity, and has provided on an outer peripheral side thereof with an electrode for external connection.

An X-ray generation device according to the present invention is an X-ray generation device comprising the X-ray tube as explained above, the X-ray generation device having: a voltage applying part switchable between a first voltage application state in which the cathode and the anode are applied with a voltage with a first electric potential difference to cause the X-ray tube to generate an X-ray, and a second voltage application state in which the cathode and the other part are applied with a voltage with a second electric potential difference which is smaller than the first electric potential difference; and at least either one detection unit of an ion current detector connected to the one part and detects the ion current when the voltage applying part is in the second voltage application state, or an electron current detector connected to the other part and detects the electron current when the voltage applying part is in the second voltage application state.

In the X-ray generation device of the present invention, the first voltage application state for operating the X-ray tube and the second voltage application state for detecting at least one of ion current detection and electron current detection can be switched, thereby making it possible to detect the pressure of the X-ray tube with high sensitivity by switching to the second voltage application state when necessary.

The X-ray generation device may be so configured to have a signal outputting portion that output a related signal of the pressure in the X-ray tube in the envelope based on detection signal of at least one detection unit of the ion current detector and the electron current detector that detects the electron current. And the information outputted from the signal outputting portion may be information indicating the pressure in the envelope or a signal indicating the property of the pressure in the X-ray tube. Or, the information outputted from the signal outputting portion be information indicating a residual lifetime until the pressure in the envelope goes out of an allowable range or a property of the residual lifetime.

Here, more specifically, the output information (related to the pressure and the residual lifetime) outputted from the signal outputting portion is calculated by comparing at least one of the detection signal of the ion current or the electron current or the calculation information which is a current ratio of the ion current versus the electron current, with the ion current, the electron current, and the current ratio thereof preliminarily measured in the X-ray tube. Further, the output information may be calculated by comparing a time change of the time increase rate of detection signal and/or the calculation signal of the ion current, the electron current, and the current ratio of these currents, with a preliminarily measured time change of the time increase rate of the detection signal and/or the calculation signal.

Effect of the Invention

According to the present invention, it is possible to provide an X-ray tube and an X-ray generation device capable of detecting the pressure in a high vacuum region with high sensitivity and accurately preventing the occurrence of an abnormal discharge and monitoring the lifetime.

BRIEF DESCRIPTION OF THE DRAWINGS

FIG. 5 is a graph of the measurement result which shows the relationship between the ion current Ii and/or the electron current Ie and the pressure at the time of vacuum measurement in the one verification example of the X-ray tube by the verification system shown in FIG. 4.

FIG. 6 is a graph of the measurement result which shows the relationship between the ion current Ii and/or the electron current Ie and the pressure at the time of vacuum measurement in the other verification example of the X-ray tube by the verification system shown in FIG. 4.

DETAILED DESCRIPTION OF THE INVENTION

Hereinafter, embodiments of the present invention will be described with reference to the drawings.

One Embodiment

Figure 1:
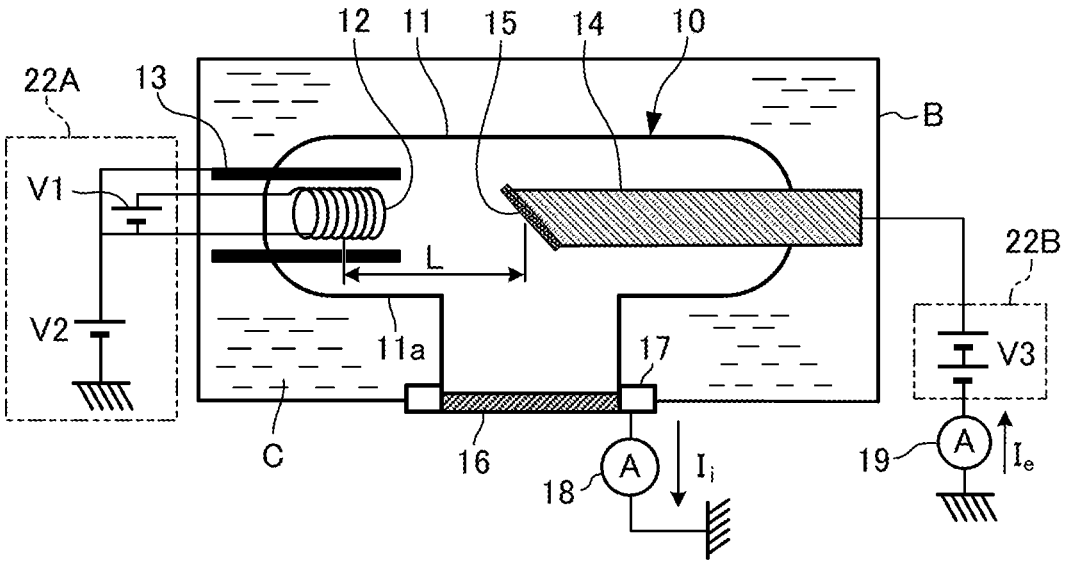
FIG. 1 is a front sectional view of the X-ray generation device provided with the X-ray tube according to one embodiment of the present invention.
Figure 2:
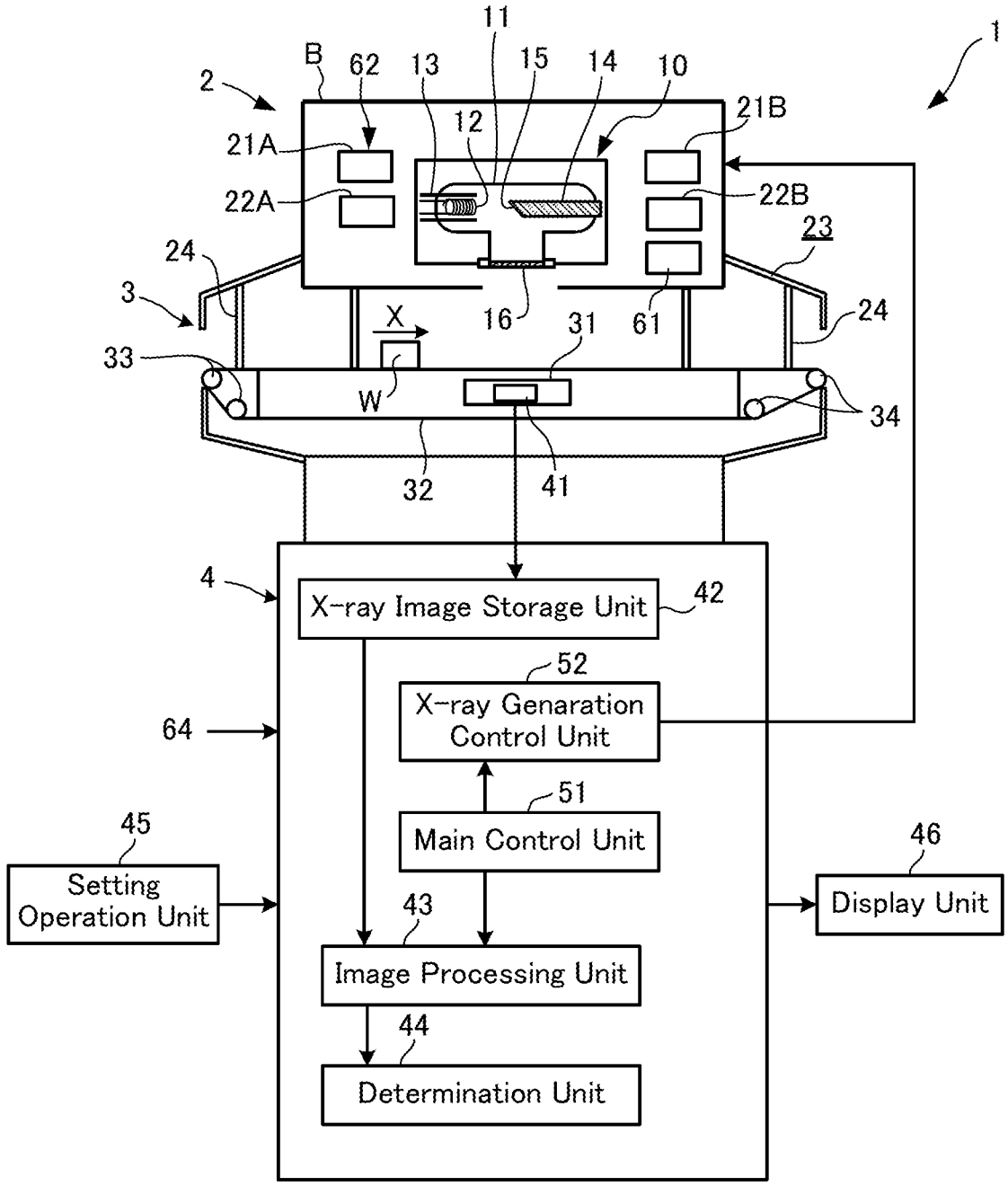
FIG. 2 is a schematic block diagram of the X-ray inspection apparatus provided with the X-ray generation device according to one embodiment of the present invention.
Figure 3:
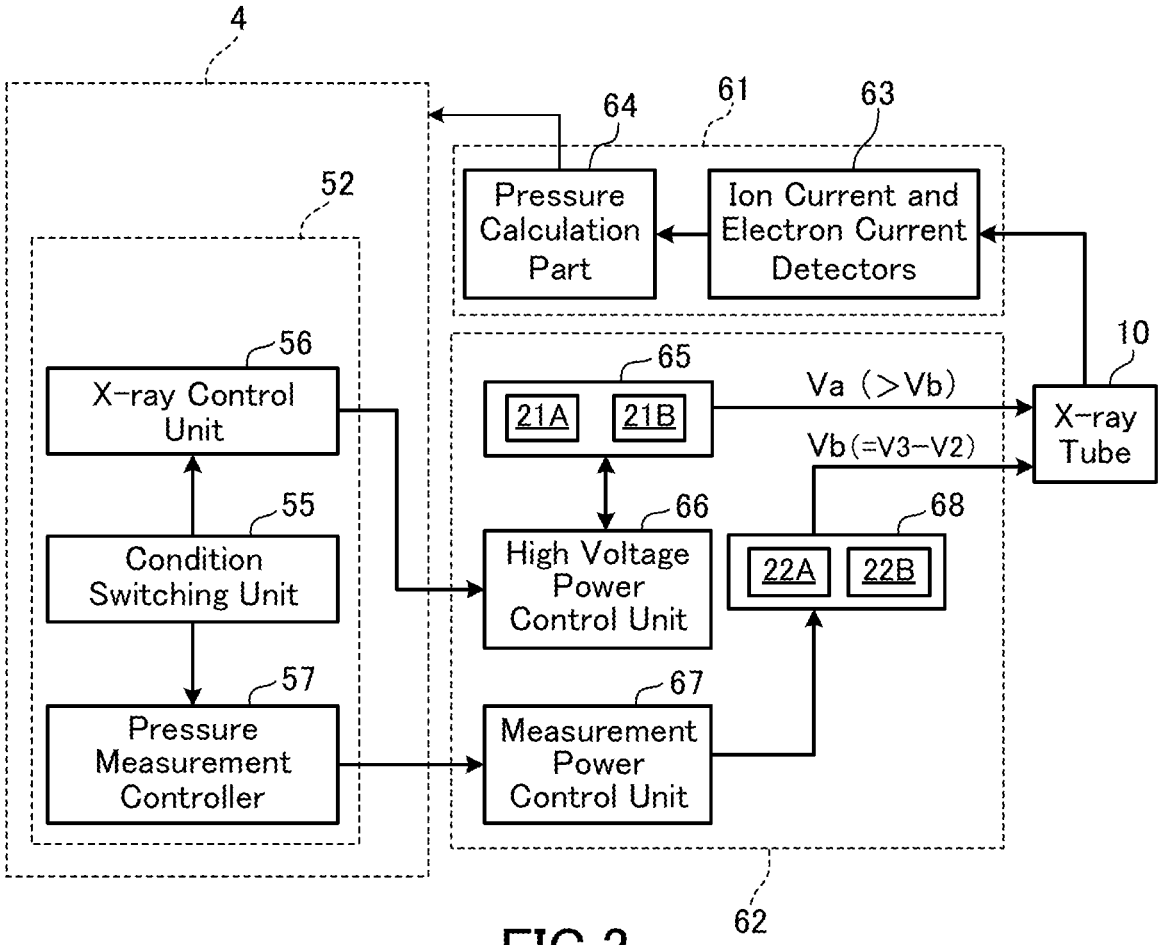
FIG. 3 is a block diagram of the control system of the X-ray generation device according to one embodiment of the present invention.

FIGS. 1 to 3 show an X-ray generation device having an X-ray tube and an X-ray inspection apparatus provided with the same according to one embodiment of the present invention.

First, the configuration will be described.

As shown in FIGS. 1 and 2, the X-ray inspection apparatus 1 of the present embodiment includes an X-ray generation unit 2 (X-ray generation device), an X-ray detection unit 3 and an X-ray inspection control unit 4.

As shown in FIGS. 1 and 2, the X-ray generation unit 2 as an X-ray generation source has an X-ray tube 10 of, for example, a two-pole X-ray tube type inside a metal box B, and is so configured that the X-ray tube 10 is immersed in the insulating oil C for cooling in the box B. The X-ray tube 10 is a vacuum sealed product in which the inside of the envelope 11 is designed to have a predetermined pressure, for example, a high vacuum of about $10^{-4}$ Pa.

The X-ray tube 10 causes electrons, emitted from the filament 12 on the cathode side in the envelope 11 and focused by the focus electrode 13, to collide with the target 15 on the anode 14 side facing the filament 12, so that the X-ray is generated from the target 15. The filament 12, the focus electrode 13 and the target 15 are respectively attached to the envelope 11 in an insulated state.

The X-ray tube 10 is so arranged that its longitudinal direction is, for example, the transport direction of the inspection article W (the direction X in FIG. 2), and the X-ray generated by the X-ray tube 10 is irradiated from the X-ray window portion 16 of the x-ray tube 10 downward and orthogonal to the transport direction. The anode 14 is of a fixed type for convenience of explanation here, but it may be of a rotary type.

As shown in FIGS. 1 and 2, the X-ray generation unit 2 has the drive power circuits 21A, 21B for driving the X-ray tube 10 into a state capable of generating X-rays, and the power supply circuits for the measurement 22A, 22B to be used while the drive power circuits 21A. 21B are not operating and are capable of allowing the X-ray tube 10 to operate as a pressure measurement device The drive power circuit 21A applies a potential corresponding to a predetermined operation voltage to the focus electrode 13 on the cathode side, and applies a predetermined lighting voltage to provide thermoelectron emission energy to the filament 12 on the cathode side. The drive power circuit 21 B applies a positive potential corresponding to the operating anode voltage to the anode 14 during high voltage operation. The potential and the electric potential difference for X-ray generation here can be arbitrarily set within a conventional range. Further, the circuit can be easily configured by grounding the contacts with the drive power circuits 21A and 21B.

The power supply circuit for the pressure measurement 22A of the X-ray tube for the pressure applies a positive potential V2 corresponding to a predetermined measurement voltage to the focus electrode 13, and applies a lighting voltage V1 to provide thermoelectron emission energy to the filament 12 on the cathode side. Similarly, the power supply circuit for the measurement 22B applies a positive potential V3 corresponding to a predetermined measurement voltage to the anode 14.

The X-ray detection unit 3 detects the X-ray irradiated from the upper X-ray generation unit 2 between the front and rear shielding curtains 24 and transmitted through the inspection article W, with respect to the inspection article W conveyed on the inspection space 23 by a conveyor. The X-ray detection unit 3 is constituted by an X-ray line sensor 31, a belt conveyor 32 for conveying the inspection article W, and a plurality of rollers 33 and 34 for driving the conveyance.

The X-ray line sensor 31 extends in a direction perpendicular to the conveyance direction along the conveyor conveyance surface of the inspection article W, and is constituted by, for example, a plurality of photodiodes aligned in a line and a scintillator extending in said extending direction above the plurality of photodiodes.

Further, as shown in FIG. 2, the X-ray line sensor 31, provided therein with an A/D conversion unit 41, is adapted to sequentially output a transmission density data of X-rays from the A/D conversion unit 41 as a line image data of the X-ray image.

Returning to FIG. 1, the envelope 11 of the X-ray tube 10 of the X-ray generation unit 2 has an envelope body 11*a* made of a material having electrical insulation, and an X-ray window portion 16 made of a material having a higher rate of X-rays transmissivity and electric conductivity than the envelope body 11*a*. Further, an electrode 17 for external connection is provided on the outer peripheral side of the X-ray window portion 16. The envelope body 11*a* may be made of a conductive material, and the X-ray window portion 16 may be attached to the envelope body 11*a* in a state of being electrically insulated.

The X-ray window portion 16 is set to a lower electric potential than the filament 12 and the focus electrode 13 on the cathode side and the target 15 on the anode 14 side, and here. The X-ray window portion 16 is grounded through the electrode 17 for external connection.

An X-ray image from the X-ray line sensor 31 is inputted to the X-ray inspection control unit 4 of the X-ray inspection apparatus 1 through the A/D conversion unit 41.

The X-ray inspection control unit 4 is provided with an X-ray image storage unit 42 that stores an X-ray image received from the X-ray line sensor 31, an image processing unit 43 that performs an image processing applying various image processing algorithms against the image data read out from the X-ray image storage unit 42, and a determination unit 44 which determines the presence or absence of a foreign object in the inspection article W based on the image processing result. The image processing algorithm referred to here is, for example, a combination of a plurality of image processing filters and image processing for feature extraction.

The X-ray inspection control unit 4 is further provided with a setting operation unit 45 for setting and inputting various parameters, and a display unit 46 that displays various information related to the X-ray inspection including inspection results and the like, and various information related to the pressure measurement including ion current and electron current.

The setting operation unit 45 is constituted by a plurality of keys and switches operated by a user, and performs setting input of various parameters and the like to the X-ray inspection control unit 4 and selection of an operation mode. The setting operation unit 45 and the display unit 46 may be integrally configured as, for example, a touch panel display.

And the display unit 46 may be constituted by another notification unit or an information output unit.

The X-ray inspection control unit 4 is also provided with a main control unit 51 that performs main control of the X-ray inspection apparatus 1 in accordance with an inspection control program stored in a ROM, and an X-ray generation control unit 52 that controls the X-ray generation unit 2 in correspondence to a control input from the main control unit 51.

The main control unit 51 outputs an X-ray tube control instruction to the X-ray generation control unit 52 and outputs a control instruction related to overall control of the X-ray inspection apparatus 1. The X-ray generation control unit 52 controls the x-ray tube 10 in accordance with the X-ray tube control instruction.

The main control unit 51 is adapted to be switchable between an X-ray inspection control mode for causing the X-ray inspection apparatus 1 to generate X-rays, and a pressure measurement mode capable of measuring the pressure in the X-ray tube 10 without causing the X-ray inspection apparatus 1 to generate X-rays.

Under the X-ray inspection control mode, the X-ray generation control unit 52 applies a lighting voltage V1 to the filament 12 while applying a high voltage between the focus electrode 13 and the anode 14 of the X-ray tube 10, so that the electrons are emitted.

As shown in FIG. 3, the X-ray generation control unit 52 cooperates with the main control unit 51 to execute a plurality of control programs, thereby making it possible to exert the functions as a condition switching unit 55, an X-ray control unit 56, and a pressure measurement controller 57.

The X-ray control unit 56 can operate the drive power circuits 21A and 21B for X-ray generation of the X-ray tube 10 under the above-described X-ray inspection control mode.

The condition switching unit 55 is capable of switching between the X-ray inspection control mode and the pressure measurement mode described above. The condition switching unit 55 is adapted to selectively operate the X-ray control unit 56 and the pressure measurement controller 57, by manual switching based on the switching request operation input from the setting operation unit 45 or by automatic switching based on the measurement request input each time the predetermined operation period has elapsed. Further, the pressure measurement controller 57 can operate the power supply circuits for the measurement 22A and 22B of the X-ray tube 10 under the above-described pressure measurement mode.

More specifically, a pressure measurement part 61 that measures and estimates the pressure in the X-ray tube 10 and outputs the same to the display unit 46 through the X-ray inspection control unit 4, and an X-ray tube drive unit 62 that drives the X-ray tube 10 while controlling to switch between the X-ray inspection control mode and the pressure measurement mode described above, are provided between the X-ray generation control unit 52 and the X-ray tube 10.

The pressure measurement part 61 includes an ion current and electron current detectors 63 selectively connected to the X-ray tube 10, and a pressure calculation part 64 to estimate the pressure of the X-ray tube 10 based on the detection signal of at least one of the ion current and the electron current from the ion current and/electron current detectors 63.

The ion current detection of the ion current and electron current detectors 63 are capable of detecting a current flowing from the X-ray window portion 16 to the ground potential as an ion current Ii (see FIG. 1) by a feeble ammeter 18, when the ion current and electron current detectors 63 are connected to the X-ray window portion 16 of the X-ray tube 10 through the electrode 17 for external connection.

On the other hand, the electron current detection of the ion current and electron current detectors 63 are capable of detecting a current flowing from the ground potential to the anode 14 as an electron current Ie (see FIG. 1) by the ammeter 19, when the ion current and electron current detectors 63 are connected to the anode 14 of the X-ray tube 10 through the measurement power circuit 22B and the ammeter 19.

The pressure calculation part 64 stores in advance a result of measuring the pressure dependency of the ion current and the electron current before measuring the pressure, and is capable of calculating a corresponding pressure of the X-ray tube 10, from the ion current Ii, the electron current Ie, or the current ratio Ii/Ie (on Current/Electron Current). Further, the pressure calculation part 64 has a function to calculate the residual lifetime of the X-ray tube 10 from the temporal change of the pressure (ion current, electron current, or current ratio thereof) of the X-ray tube 10, and to output the residual lifetime to another functional unit in the X-ray inspection control unit 4 (for example, a residual lifetime informing part).

The X-ray tube drive unit 62 has a high voltage power control unit 66 and a measurement power control unit 67 corresponding to the X-ray control unit 56 and the pressure measurement controller 57, and is capable of switching and controlling the high-voltage power circuit 65, having the drive power circuits 21A and 21B for generating X-ray of the X-ray tube 10, and the measurement power circuit 68 for pressure measurement, having the power supply circuits for the measurement 22A and 22B.

The X-ray tube drive unit 62 constitutes a voltage applying part capable of switching between a first voltage applying state and a second voltage applying state, the first voltage applying state being a state in which drive voltages corresponding to the potentials of the cathode and the anode of the X-ray tube 10 are applied at a first potential variation Va from the high voltage power circuit 65 by the high voltage power control unit 66 so as to generate the X-ray in the X-ray tube 10, the second voltage applying state being a state in which drive voltages for pressure measurement corresponding to the potentials V2, V3 of the cathode and the anode, respectively, of the X-ray tube 10 are applied at a second potential variation Vb which is smaller than the Va from the measurement power circuit 68 by the measurement power control unit 67.

The display unit 46 of the X-ray inspection apparatus 1 in the present embodiment has a function of a signal outputting portion that outputs a related signal of the pressure in the X-ray tube in the envelope 11 based on the detection signal of the ion current and the electron current. Further, the output information outputted from the display unit 46 may be information indicating the pressure in the envelope 11 or the signal indicating the property of the pressure in the X-ray tube. Furthermore, the output information outputted from the display unit 46 may be information indicating the residual lifetime until the pressure in the envelope 11 deviates from the preset allowable range, or information indicating the property of the residual lifetime (for example, a display of characters or marks indicating the replacement time of the X-ray tube 10).

Next, the operation of the X-ray inspection apparatus 1 in the present embodiment will be described.

The X-ray inspection apparatus 1 in the present embodiment configured as described above is capable of X-ray inspection and pressure measurement, and usually performs X-ray inspection, and pressure measurement is performed on a regular basis (once a day, once a week, or the like). The operation of the X-ray tube 10 at the time of X-ray inspection and pressure measurement of the X-ray inspection apparatus 1 will be respectively described below.

First, the operation of the X-ray tube 10 at the time of X-ray inspection will be described. The X-ray inspection of the X-ray inspection apparatus 1 is similar to the conventional X-ray inspection.

When the X-ray control unit 56 operates in response to a switching instruction from the condition switching unit 55 of the X-ray generation control unit 52 (in the X-ray inspection control mode), the high voltage power control unit 66 causes the drive power circuits 21A and 21B to operate. A DC voltage having a negative potential, for example −50 kV, is applied to the cathode. Further, a voltage of about 10 V, for example, direct current or alternating current, is applied to the filament 12, and the filament 12 is turned on to have a high temperature, so that electrons are emitted. Also, a DC voltage having a negative potential, for example, −50 kV, is applied to the focus electrode 13, so that the focus electrode 13 plays a role of focusing the electrons emitted from the filament 12. On the other hand, the target 15 is applied with a DC voltage having a positive potential, for example, about +50 kV, whereby the electrons emitted from the filament 12 are accelerated and collide with the target 15 to generate X-rays from the target 15. Then, the generated X-rays are emitted to the outside after passing through the X-ray window portion 16. Thus, the inspection article W is inspected by the emitted X-rays.

Next, the operation of the X-ray tube 10 at the time of pressure measurement will be described.

In the pressure measurement mode in which the pressure measurement controller 57 operates in response to the switching instruction from the condition switching unit 55, the filament 12 and the focus electrode 13 on the cathode side are applied with a predetermined positive potential V2, and the filament 12 is applied with the lighting voltage V1 that provides thermoelectron emission energy to the filament 12 in the cathode side, by the power supply circuit for the measurement 22A of the measurement power control unit 67. Further, a predetermined positive potential V3 higher than V2 is applied to the target 15 on the anode 14 side by the power supply circuit for the measurement 22B. And the X-ray window portion 16 constituting an ion collector is set to earth potential, without connecting DC power supply.

A positive potential V2 is applied to the filament 12 and the focus electrode 13 on the cathode side. Here, the positive potential V2 may be any potential as long as it is higher than 0 V, for example, set within a range from about 10 V to about 100 V however, it is particularly preferable to be set 10 V or higher and 50 V or lower.

The voltage V1 for lighting the filaments 12 depends on the individual filaments, but may be a DC voltage or an AC voltage.

The positive potential V3 applied to the target 15 on the anode 14 side may be a potential higher by about 100 V or more than the positive potential V2 applied to the filament 12. For example, 100 V or higher and 5 kV or lower. However, in consideration of the measurement stability of the ion current Ii, it is more preferable that the voltage is 100 V or higher and 3 kV or lower.

In this pressure measurement mode, electrons emitted from the filament 12 are attracted to the target 15 on the anode 14 side, which is an anode with a higher positive potential V3, so that the electrons are accelerated, and collide against the molecules of gas remaining in the envelope 11, with the result that the molecules are electrically disassociated (ionized). Then, the positive ions after ionization of the gas molecules are attracted to the ground potential, which is a lower electric potential, and reach the X-ray window portion 16 to be neutralized or inactivated to return to the gas molecules. At this time, a weak ion current Ii flows from the X-ray window portion 16 to the ground potential. On the other hand, an electron current Ie flows from the ground potential to the target 15 on the anode 14 side constituting an anode.

The ion current Ii flowing through the X-ray window portion 16 and the electron current Ie flowing through the target 15 on the anode 14 are respectively measured by the feeble ammeter 18 and the ammeter 19 of the ion current and electron current detectors 63, outputted to the pressure calculation part 64, and converted to pressure and residual lifetime.

The features of the pressure measurement of the present invention in this pressure measurement mode will be described.

The distance between the target 15 and the anode filament 12 is sufficiently longer than the distance between the focus electrode 13 and the filament 12. As a result, the free path length L of electrons can be increased, and the sensitivity S (ionization vacuum gauge coefficient) of the pressure measurement can be improved.

Further, in this pressure measurement mode, a generation factor such as floating electrons which disturbs the ion current Ii is removed from the X-ray window portion 16 serving as an ion collector. Further, the X-ray window portion 16 is, for example, a substantially disc shape made of metal beryllium, and has an area larger than the area of the target 15. Thereby, the ion collection efficiency β can be increased, so that the sensitivity S (ionization vacuum gauge coefficient) of the pressure measurement can be improved.

Therefore, the pressure of the X-ray tube 10 can be detected with high sensitivity by the principle of the ionization vacuum gauge.

In addition, in the present embodiment, as described later as a verification example, at a pressure ($10^{-2}$ Pa), at which intermittent abnormal discharges occur, or greater, the electron current Ie increases sharply from the slight increase as well as the pressure increases. On the other hand, a linear or greater increase of the ion current Ii expresses.

Using this phenomenon, it is possible to improve the accuracy of measuring the pressure that causes occurrence of the abnormal discharge and reaching at the lifetime, by storing the measurement data of the electron current Ie or the ion current Ii, or the ion current Ii/the electron current Ie, and monitoring a time increase rate (for example, ([present data]−[previous data])/[previous data]).

Thus, according to the present embodiment, it is possible to provide an X-ray tube 10 and an X-ray inspection apparatus 1 capable of detecting the pressure in a high vacuum region with high sensitivity and accurately preventing the occurrence of the abnormal discharge and monitoring the lifetime.

Verification Example 1

Figure 4:
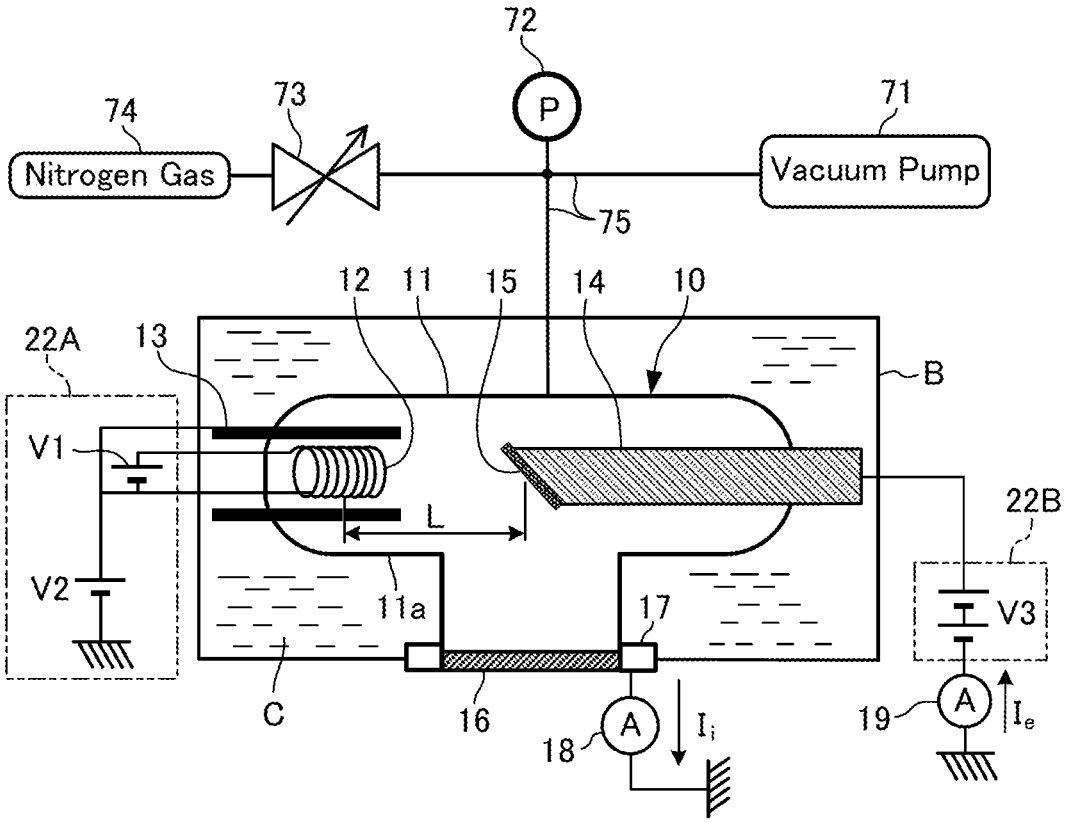
FIG. 4 is a block diagram of the system which verifies that pressure measurement of an X-ray tube is possible from the ion current detected by the X-ray generation device according to one embodiment of the present invention.

FIG. 4 shows the configuration of a system for verifying that the pressure can be measured from the ion current and the electron current detected in the X-ray tube 10 of the present embodiment.

As shown in FIG. 4, this verification system is so configured that a vacuum pump 71, a vacuum gauge 72, a gas introduction valve 73 with the divergence adjustment function, and an introduction gas tank 74 are connected to the X-ray tube 10 through a vacuum pipe 75. In this verification system, the inside of the envelope 11 of the X-ray tube 10 for test is exhausted by the vacuum pump 71 and the nitrogen gas, which is an inert gas, is intermittently introduced into the envelope 11 from the introduction gas tank 74 through the gas introduction valve 73 with the divergence adjustment function, thereby making it possible to have the inside of the envelope 11 at a predetermined vacuum state.

At the time of verification by this verification system, together with the vacuum exhaustion, a predetermined positive potential V2 is applied from the power supply circuit for the measurement 22A to the filament 12 on the cathode side and the focus electrode 13, the lighting voltage V1 is applied to the filament 12 on the cathode side, and a predetermined positive potential V3 is applied from the power supply circuit for the measurement 22B to the target 15 on the anode 14 side.

Then, the ion current Ii of the X-ray tube 10 is detected by the feeble ammeter 18 and the electron current Ie is detected by the ammeter 19 at a predetermined pressure interval in a predetermined pressure range including the vacuum state used as the X-ray tube 10.

As a verification example 1 by the verification system shown in FIG. 4, the vacuum dependency of the electron current Ie flowing in the anode and the ion current Ii flowing in the X-ray window portion 16 was measured, where the positive potential V2 applied to the filament 12 and the focus electrode 13 is set constant, the positive potential V3 applied to the anode (target 15 on the anode 14 side) is set constant, and the flow rate of the introduced nitrogen gas is varied, so that the pressure is used as a parameter.

Figure 5A:
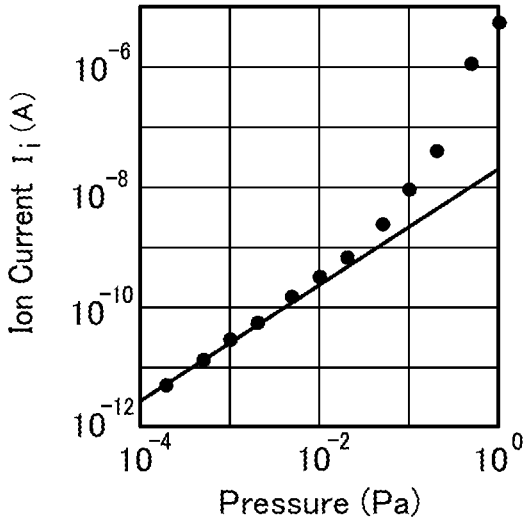
FIG. 5A shows the variation of the ion current Ii at the X-ray window portion according to the pressure.
Figure 5B:
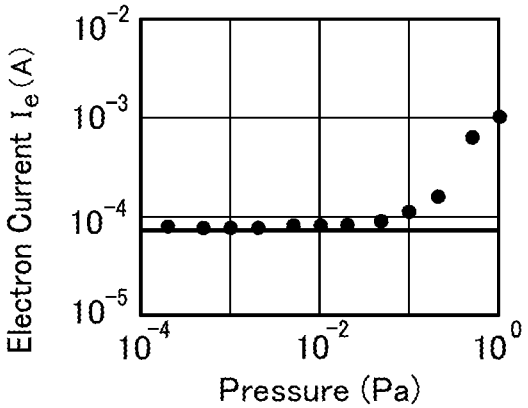
FIG. 5B shows the variation of the electron current Ie of the X-ray tube according to the pressure.
Figure 5C:
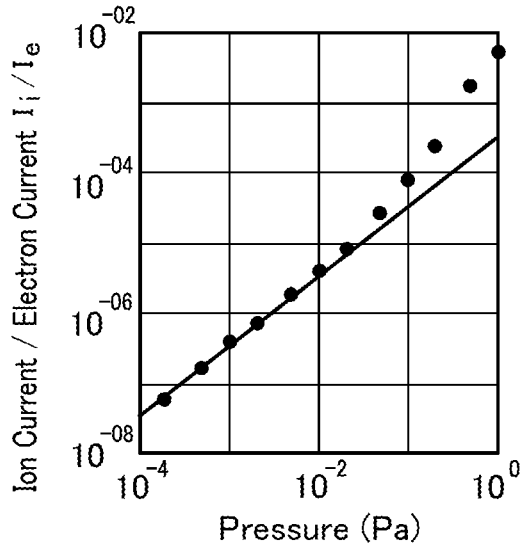
FIG. 5C shows the variation of the ratio Ii/Ie of the ion current Ii and the electron current Ie according to the pressure.

FIG. 5A, FIG. 5B and FIG. 5C show the pressure dependencies of the ion current (Ii), the electron current (Ie), and the current ratio (Ii/Ie), respectively. In the case of the verification example 1, the positive potential V2 is set to 20 V on the side of the filament 12 and the focus electrode 13, and the anode side positive potential V3 is set to 250 V.

In this case, in a vacuum region of 104 Pa to $10^2$ Pa, the ion current Ii is a very weak current of about $10^{-9}$ (A) to about $10^{-12}$ (A), but increases at the first power of the pressure, while the electron current Ie stays constant.

This reflects the fact that, when focusing on one electron among many electrons that are emitted from the filament 12 and accelerated by the positive potential V3, the one electron collides with a gas molecule in the middle of flight to generate one gas ion. This means that, in this vacuum region, the ion current Ii increases at the first power of the pressure which is the concentration of the gas, while the electron current Ie expresses a constant current because the increase of electrons due to the gas collision is not large. Also, reflecting these facts, the current ratio Ii/Ie of the ion current Ii and the electron current Ie follows the first power of the pressure. In the pressure region of $10^{-4}$ Pa to $10^{-2}$ Pa, the X-ray tube 10 of the present example hardly generated the abnormal discharge.

On the other hand, in the pressure region of $10^{-2}$ Pa to 1 Pa, the ion current Ii increases at the first power or more of the pressure, and the electron current Ie gradually increases from a certain value.

Further, the increase rate of the ion current Ii and the electron current Ie becomes larger on the low vacuum side (the intermittent discharge side in the figure). This is considered to be due to the fact that in this vacuum region, the gas concentration becomes high, so that the electron that collided with the gas or the electron ionized from the gas are reaccelerated by the anode potential V3, then these electrons again collide with the gas molecules, thereby increasing the electron current Ie while further increasing the ion current Ii.

Reflecting these, the current ratio Ii/Ie of the ion current Ii and the electron current Ie is nonlinearly increasing at the first power or more of the pressure. In addition, it was confirmed that the X-ray tube 10 expresses intermittent abnormal discharges at the pressure where the pressure is about $10^{-2}$ Pa or more.

From above results, it is known that, in the X-ray tube 10 with a pressure measurement function of this embodiment, a wide range of pressure can be measured, by measuring the ion current Ii and the electron current Ie in the X-ray tube, and monitoring the ion current Ii, electron current Ie or the current ratio Ii/Ie of these, from the pressure of about $10^{-4}$ Pa where the abnormal discharge does not express to the pressure of about $10^{-2}$ Pa where the intermittent abnormal discharge expresses, and further to the pressure of about 1 Pa where the abnormal discharge frequently expresses.

By the way, in the verification example 1 shown in FIGS. 5A to 5C, the filament side positive potential V2 is set to 20 V and the anode side positive potential V3 is set to 250 V. However, in this case, at the pressure of $10^{-4}$ Pa order of magnitude, the ion current becomes as weak as about $10^{-12}$ (A), which may cause a practical problem.

Verification Example 2

Therefore, as a verification example 2, an examination was conducted about the setting range of the filament side positive potential V2 and the anode side positive potential V3, in which it is possible to increase the ion current Ii at a pressure of $10^{-4}$ Pa order of magnitude, and to secure the increase of the ion current at the first power or more of the pressure that expresses in the pressure of $10^{-2}$ Pa to 1 Pa and the nonlinear increase of the electron current Ie from the certain value.

The filament side positive potential V2 may be a positive potential in order to collect ions in the ion collector. In the experiment, the positive potential V2 was set to a positive potential of 10 V to 10 V, but the change in ion current was small. Therefore, it was determined that the filament side positive potential V2 should be set to a positive potential of 100 V or less.

Figure 6A:
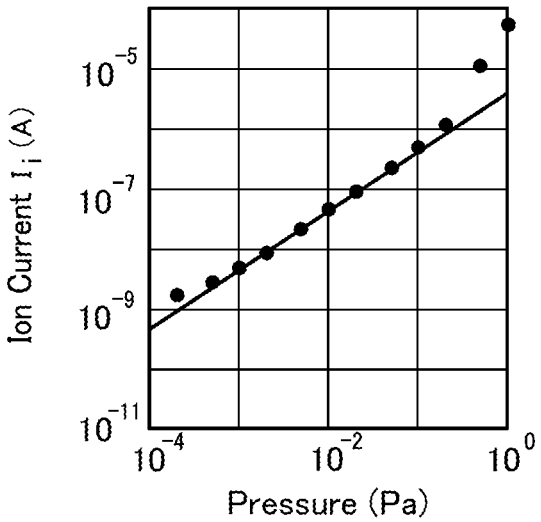
FIG. 6A shows the variation of the ion current Ii at the X-ray window portion increased from one verification example according to the pressure.
Figure 6B:
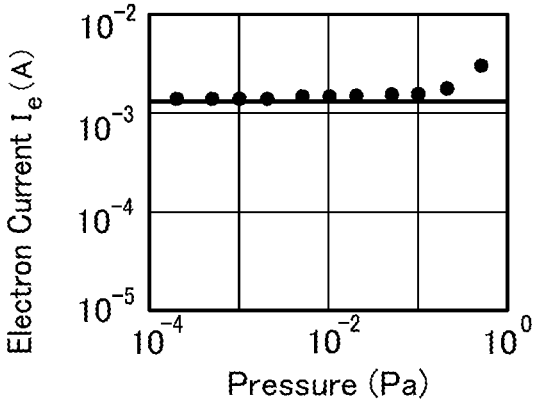
FIG. 6B shows the variation of the electron current Ie of the X-ray tube increased from one verification example according to the pressure.
Figure 6C:
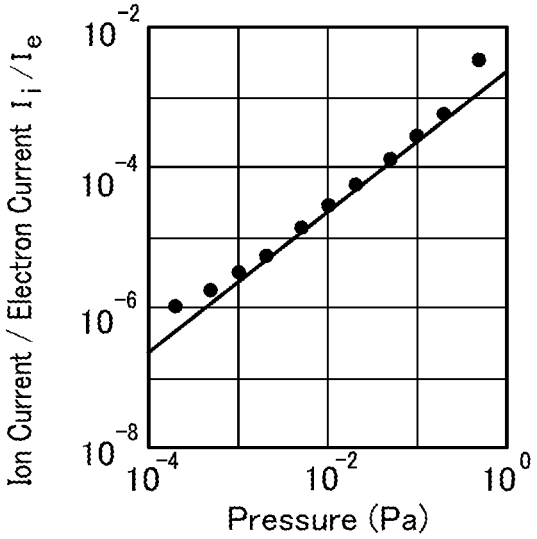
FIG. 6C shows the variation of the ratio Ii/Ie of the ion current Ii and the electron current Ie increased from one verification example according to the pressure.

Next, the vacuum dependency of the ion current Ii and the electron current Ie was measured, where the filament side positive potential V2 was fixed at 20 V and the anode side positive potential V3 was varied from 250 V to 5 kV. FIG. 6 shows the pressure dependency in the case where the filament side positive potential V2 is set to 20 V and the anode side positive potential V3 is set to 3 kV.

By setting the anode side positive potential V3 from 250 V to 3 kV, as shown in FIG. 6, the ion current Ii at a pressure of $10^{-4}$ Pa increased about two orders of magnitude from $5\times10^{-12}$ (A) in the verification example 1 to $1\times10^{-9}$ (A) in the verification example 2.

It is considered that setting the anode potential V3 to 3 kV increases the kinetic energy of the flying electrons and increases the ionization efficiency $\sigma i$ when the electrons collide with the gas. The electron current Ie at $10^{-4}$ Pa also increased by one digit from $1\times10^{-4}$ (A) to about $1\times10^{-3}$ (A).

On the other hand, the increase of the ion current Ii at the first power or more of the pressure and the non-linear increase tendency of the electron current Ie from the certain value expressed at a pressure of $10^{-2}$ Pa to 1 Pa decreased its inclination.

This is because the original ion current and the electron current were increased by setting the anode potential V3 to 3 kV, and the nonlinear increase amount of the ion current and the electron current at the pressure of $10^{-2}$ Pa to 1 Pa is about 5 times, which is decreased compared with the case where the anode potential V3 is set to 250 V As described above, in the present embodiment, when the anode potential V3 is set to 3 kV measurement of the ion current or electron current of the X-ray tube or the current ratio Ii/Ie thereof is relatively easy. On the other hand, the potential of the 3 kV is close to the higher limit for monitoring the non-linear increase rate of the ion current Ii and the electron current Ie, and in fact, it is resulted that the anode potential of about 5 kV is the measurement limit of the non-linear increase rate of the ion current and the electron current.

From these results, it is preferable to set the anode potential V3 to 5 kV or lower.

Also from the above results, it is possible to provide an X-ray tube 10 having a function to measure the pressure over a wide range from the pressure of about $10^{-4}$ Pa where the abnormal discharge does not express in the present X-ray tube 10 to the pressure of 10 Pa where the abnormal discharge frequently occurs and lifetime is reached.

In addition, it is possible to enable measurement of a practical high vacuum (for example, $10^{-4}$ Pa) from an early stage immediately after production of the X-ray tube 10.

Furthermore, by monitoring the rate of increase of the ion current Ii or the electron current Ie or the ratio of these currents, it is possible to enhance the measurement accuracy of the pressure at which the abnormal discharge of the X-ray tube expresses.

Therefore, it can be understood that, although it is an X-ray tube with a pressure measurement function that uses the electrode as it is, the X-ray tube is capable of increasing the free path length L of the electrons, of performing a measurement of wide range of pressure with high sensitivity in principle, and of predicting the occurrence of the abnormal discharge with high accuracy by utilizing the non-linear increase of the ion current and the electron current for measuring the pressure in the pressure region where the abnormal discharge occurs.

In the above-described one embodiment, in the pressure measurement mode, the X-ray filament is used as it is as a filament, the X-ray target is used as the anode, and the X-ray window is used as the ion collector. However, in the present invention, the X-ray window may be used as an anode and the X-ray target may be used as an ion collector. This means that, in the present invention, the X-ray tube may be so configured that either one (arbitrary one) of the X-ray window portion or the anode of the X-ray tube is set to a lower electric potential than the other one of the X-ray window portion or the anode, and set to a lower electric potential than the cathode, and the ion current can be detected through the arbitrary one of the X-ray window portion or the anode. Therefore, the X-ray tube according to the present invention includes a configuration in which the arrangement of the ion collectors is reversed as shown in another embodiment described below, in addition to the configuration as in the one embodiment where the one as referred to here is the X-ray window and the other is the anode.

Another Embodiment

Figure 7:
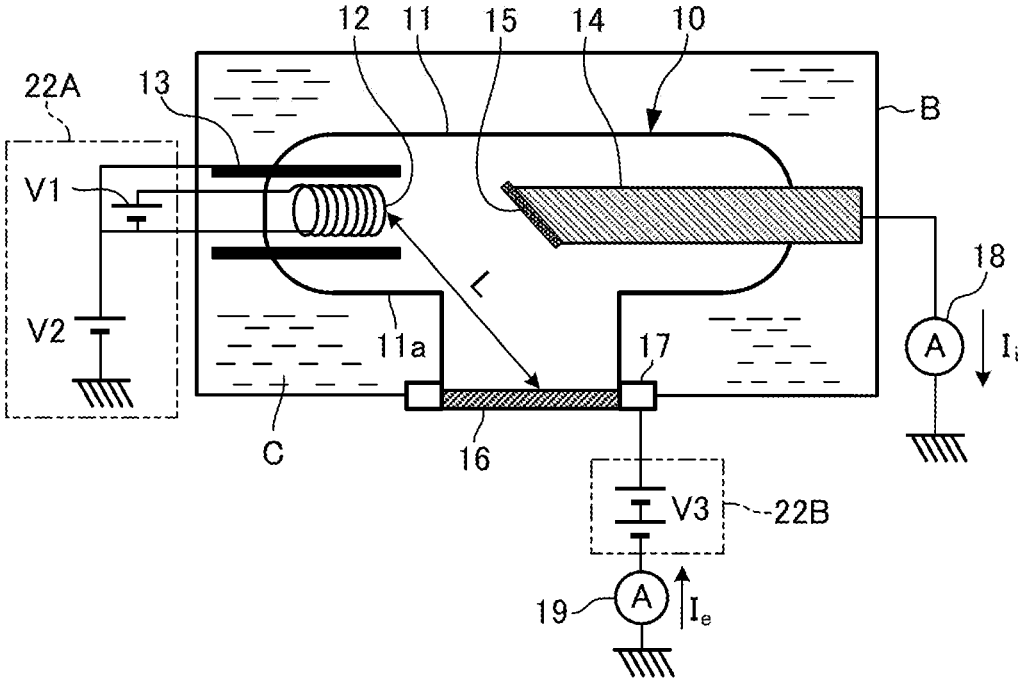
FIG. 7 is a front sectional view of the X-ray generation device provided with the X-ray tube according to another embodiment of the present invention.

FIG. 7 shows an X-ray generation device according to another embodiment of the present invention.

The present embodiment is the same as the one embodiment described above except that the X-ray window is an anode and the X-ray target is an ion collector in the pressure measurement mode of the X-ray tube. Therefore, the same reference numerals are used for the same configuration as that of the one embodiment, and the difference from the one embodiment will be described.

In the present embodiment, when the condition switching unit 56 of the X-ray generation control unit 52 is switched to the pressure measurement mode, the ion current and electron current detectors 63 can be selectively connected to the anode 14, and a leakage current flowing out from the target 15 at the time of the connection can be detected as the ion current Ii.

The pressure calculation part 64, as in the case of the one embodiment, stores the result of measuring the pressure dependency of the electron current and the ion current in advance for each X-ray tube 10 prior to pressure measurement, and detects the electron current e or the ion current Ii of the X-ray tube 10, or calculates the current ratio Ii/Ie, thereby to estimate the pressure of the corresponding X-ray tube 10.

As described above, in the present embodiment in which one of the X-ray window portion 16 or the anode 14 serves as the anode and the other serves as the X-ray window portion 16, it is possible to collect the gas, ionized by the collision with the electrons accelerated from the filament 12 side to the X-ray window portion 16 side, which are positive ions, in the target 15 serving as an ion collector, and measure the ion current Ii which is approximately proportional to the pressure in the envelope 11.

Therefore, it is possible to provide the X-ray tube 10 and the X-ray inspection apparatus 1 capable of increasing the free path length L of electrons from the filament 12 and the focus electrode 13 side to the X-ray window portion 16 side while securing the pressure measurement function using the electrode in the envelope 11 as it is, detecting the pressure with high sensitivity and accurately preventing the occurrence of abnormal discharge and monitoring the lifetime.

Also in this embodiment, it is possible to provide the X-ray tube 10 capable of measuring the pressure in high sensitivity and wide range in principle, and of predicting the occurrence of abnormal discharge with high accuracy by utilizing non-linear increase of ion current Ii and electron current Ie for pressure measurement in the pressure region where abnormal discharge occurs.

In each of the above embodiments, the present invention is embodied as an X-ray inspection apparatus using an X-ray tube and the X-ray generation device corresponding to the X-ray generation unit 2. However, the present invention is useful not only in the field of an X-ray generation device to be used in an X-ray inspection apparatus, but also in the field of other types of X-ray generation device and X-ray inspection apparatus that uses an X-ray tube.

As described above, the present invention provides an X-ray tube and an X-ray generation device capable of detecting the pressure in a high vacuum region with high sensitivity and accurately preventing the abnormal discharge and monitoring the lifetime, and therefore, the present invention is useful for X-ray tubes and X-ray generation devices in general that can measure the pressure in the envelope.

EXPLANATION OF REFERENCE NUMERALS

1 X-ray Inspection Apparatus
2 X-ray Generation Device

3 X-ray Detection Device
4 X-ray Inspection Control Unit
10 X-ray Tube
11 Envelope
11*a* Envelope Body
12 Filament (Cathode)
13 Focus electrode (Cathode)
14 Anode
15 Target (Anode)
16 X-ray Window Portion
17 Electrode for External Connection
18 Feeble Ammeter
19 Ammeter
21A, 21B Drive Power Circuit
22A, 22B Power Supply Circuit for the Measurement
23 Inspection Space
31 X-ray Line Sensor
32 Belt Conveyor
33, 34 Rollers
41 A/D Converter
42 X-ray Image Storage unit
43 Image Processing unit
44 Determination Unit
45 Setting Operation Unit
46 Display Unit
51 Main Control Unit
52 X-ray Generation Control Unit
54 Aging Condition Selection Unit
55 Condition Switching Unit
56 X-ray Control Unit
57 Pressure Measurement Controller
61 Pressure Measurement Part
62 X-ray Tube Drive Unit
63 Ion Current and Electron Current Detectors
64 Pressure Calculation Part
65 High Voltage Power Circuit
66 High Voltage Power Control Unit
67 Measurement Power Control Unit
68 Measurement Power Circuit
71 Vacuum Pump
72 Vacuum Gauge
73 Gas Introduction Valve
74 Introduction Gas Tank
75 Vacuum Pipe
V1 Lighting Voltage
V2 Positive Potential (filament side positive potential)
V3 Positive Potential (anode side positive potential)

The invention claimed is:

1. An X-ray tube, comprising:

an envelope that holds inside thereof at a predetermined pressure;

a cathode provided in the envelope, the cathode emitting electrons; and an anode provided in the envelope facing to the cathode, the anode generating X-ray, wherein the envelope has an envelope body and an X-ray window portion having a higher X-rays transmissivity and a higher electric conductivity than those of the envelope body, when either one part of the X-ray window portion or the anode is set to a lower electric potential than both an electric potential of the other part of the X-ray window portion or the anode and an electric potential of the cathode, detection of at least either one of an ion current through the one part or an electron current through the other part is possible.

2. The X-ray tube according to claim 1, wherein the one part is the X-ray window portion, and the other part is the anode.

3. The X-ray tube according to claim 1, wherein the one part is the anode and the other part is the X-ray window.

4. The X-ray tube according to claim 1, wherein the X-ray window portion is made of metal having a predetermined electric conductivity, and has provided on an outer peripheral side thereof with an electrode for external connection.

5. An X-ray generation device comprising the X-ray tube according to claim 1, the X-ray generation device having:

a voltage applying part switchable between a first voltage application state in which the cathode and the anode are applied with a voltage with a first electric potential difference to cause the X-ray tube to generate an X-ray, and a second voltage application state in which the cathode and the other part are applied with a voltage with a second electric potential difference which is smaller than the first electric potential difference; and at least either one detection unit of an ion current detector that is connected to the one part and that detects the ion current when the voltage applying part is in the second voltage application state, or an electron current detector that is connected to the other part and that detects the electron current when the voltage applying part is in the second voltage application state.

6. The X-ray generation device according to claim 5, having a signal outputting portion that outputs a related signal of the pressure in the X-ray tube in the envelope based on detection signal of at least one detection unit of the ion current detector and the electron current detector that detects the electron current.

7. The X-ray generation device according to claim 6, wherein the information outputted from the signal outputting portion is a signal indicating the pressure in the envelope or a property of the pressure in the X-ray tube.

8. The X-ray generation device according to claim 6, wherein the information outputted from the signal outputting portion is information indicating a residual lifetime until the pressure in the envelope goes out of an allowable range or a property of the residual lifetime.

9. The X-ray generation device according to claim 7, wherein the information outputted from the signal outputting portion is calculated from at least one of the ion current, the electron current, the current ratio of the ion current versus the electron current, or a time increase rate of the ion current, the electron current or the current ratio.

* * * * *